US006237693B1

(12) United States Patent
Deaton

(10) Patent No.: US 6,237,693 B1
(45) Date of Patent: May 29, 2001

(54) FAILSAFE SAFETY VALVE AND METHOD

(75) Inventor: Thomas M. Deaton, Houston, TX (US)

(73) Assignee: Camco International Inc., Houston, TX (US)

( * ) Notice: Subject to any disclaimer, the term of this patent is extended or adjusted under 35 U.S.C. 154(b) by 0 days.

(21) Appl. No.: 09/374,346

(22) Filed: Aug. 13, 1999

(51) Int. Cl.[7] ..... E21B 34/10

(52) U.S. Cl. ..... 166/375; 166/321; 166/324; 166/386; 166/332.7; 166/151; 166/187; 251/58; 251/63.6; 137/492.5; 137/522; 137/629

(58) Field of Search ..... 166/126, 128, 166/142, 149, 151, 183, 185, 187, 188, 319, 321, 324, 332.1, 332.7, 375, 386; 251/58, 62, 63.6; 137/488, 492.5, 522, 629

(56) References Cited

U.S. PATENT DOCUMENTS

| | | | |
|---|---|---|---|
| 4,140,153 | | 2/1979 | Deaton . |
| 4,276,937 | | 7/1981 | Calhoun et al. . |
| 4,444,266 | | 4/1984 | Pringle . |
| 4,467,867 | * | 8/1984 | Baker . |
| 4,495,998 | | 1/1985 | Pringle . |
| 4,621,695 | | 11/1986 | Pringle . |
| 4,660,646 | | 4/1987 | Bizzard . |
| 4,716,969 | | 1/1988 | Pringle . |
| 4,791,991 | | 12/1988 | Morris et al. . |
| 4,976,317 | | 12/1990 | Leismer . |
| 5,179,973 | | 1/1993 | Dickson et al. . |
| 5,310,004 | | 5/1994 | Leismer . |
| 6,079,497 | * | 6/2000 | Johnston et al. ..... 166/332.7 X |
| 6,109,351 | | 8/2000 | Beall . |

* cited by examiner

*Primary Examiner*—Roger Schoeppel
(74) *Attorney, Agent, or Firm*—Trop, Pruner & Hu P.C.

(57) ABSTRACT

A subsurface well safety valve having a flow tube telescopically movable in a housing for controlling the movement of a valve closure member. A piston and cylinder assembly actuates the flow tube and is in communication with hydraulic control fluid from the well surface on one side and a gas biasing chamber on the second side and includes a spring acting on the flow tube to close the valve. An equalizing system equalizes fluid pressure on opposite sides of the piston and cylinder assembly in the event of a failure in the seal between the piston and cylinder thereby allowing the spring to close the valve. The equalizing system uses fewer components than previous designs and utilizes a new reference chamber design that allows the reference chamber and the piston to be positioned within the same axial length reducing the overall length of the safety valve over previous designs.

32 Claims, 10 Drawing Sheets

FAILSAFE SAFETY VALVE AND METHOD

BACKGROUND

1. Field of Invention

The present invention relates to the field of downhole tools. More specifically, the invention relates to a device and method for use in a downhole well tool having a hydraulic piston and cylinder assembly.

2. Related Art

Subsurface safety valves are positioned in a well to allow control of flow to the surface, particularly during a blowout, to avoid damage to people, the environment, and equipment and to avoid loss of hydrocarbons. In one type of safety valve, the valve is opened by the application of hydraulic fluid from the well surface and closed by a biasing means, such as an enclosed pressure reference chamber and a mechanical spring.

Safety valves must close under all circumstances. If there is a failure of the safety valve, the safety valve must be failsafe in the closed position so that the valve closes during any failure of the seals or other valve components. As valves are set deeper, safety valves incorporate reference chambers having compressed gas for a biasing force in addition to a biasing spring as a way to overcome the force of the hydrostatic head. The gas acts against a piston area to create a closing force much higher than that obtainable with a conventional mechanical spring.

The piston is attached to the flow tube used to open and close the safety valve and is, therefore, at least partially exposed to the tubing pressure. Thus, to maintain the gas charge and the hydrostatic control on the piston, the piston includes seals isolating the various pressures applied to the piston. If the seals leak or fail, loss of the compressed biasing gas charge may reduce the available biasing force to a level that is insufficient to close the valve. Likewise, if the seals leak or fail, high pressure tubing gas may overcome the biasing gas pressure to prevent valve closure. To overcome the dangers associated with seal leak or failure, certain gas biased safety valves, such as those disclosed in U.S. Pat. Nos. 4,660,646 and 4,976,317, allow a valve to failsafe close if the gas charge is lost.

Prior failsafe gas biased subsurface safety valves typically require numerous parts and seals to operate. For example, previous designs typically require relatively complex release mechanisms to operate. Typically, the prior devices have a spring that has a relatively small biasing force and is used to bias the piston control valve of the piston to an open position. Another spring of the prior devices is used in a release mechanism that releases separate piston components in the event of a seal failure. The separation of the piston components facilitates equalization of the pressure above and below the piston allowing the spring acting on the flow tube to lift the flow tube and close the safety valve. This operation is described in U.S. Pat. No. 4,660,646 which uses the spring force of a collet as the "other" spring in the release mechanism. U.S. Pat. No. 4,976,317 discloses another embodiment that uses two mechanical springs including one in the release mechanism and one to bias the piston valve open.

The use of the multiple components adds complexity, length, and expense to the safety valve. Thus, despite the use of the prior art features, there remains a need for a gas biased subsurface safety valve that is simpler in design, more compact, and less costly relative to prior devices while providing the same failsafe features.

Additionally, due to the harsh environments of wells and the reliability requirements of safety valves, safety valves are typically made from relatively expensive materials, such as Inconel alloy 718. Also, safety valves are typically relatively long in order to accommodate all of the components required for operation. For example, present safety valves typically mount the piston, the filter, and the gas charge in stacked relation so that each occupies a separate axial length of the safety valve. Due to the relatively high cost of material, however, any reduction in the length of the safety valve results in substantial cost savings. Accordingly, there is a continuing need for shorter safety valves that perform the same functions of previous safety valves.

One consideration involved in the design of the safety valve involves maintaining a seal within and the packaging of the gas, or reference, charge, particularly the interface between the gas charge and the operating piston. Typically, the gas charge includes a liquid, such as an oil, between the gas charge and the piston to facilitate sealing and lubrication. One problem associated with such a system involves maintaining the gas/liquid interface at a position removed from the piston, particularly during shipping of the safety valve when the valve may be oriented in a variety of positions. One manner of addressing this problem is shown in U.S. Pat. No 4,976,317 which discloses the use of a reference chamber comprising a relatively small diameter tubing wrapped around the safety valve a plurality of times encircling the main bore and positioned within a separate compartment within the body of the valve. The small diameter combined with its length (provided by the plurality of times that the tubing is wrapped around the valve body) act to prevent the interface of the liquid and gas from reaching the piston. The wrapping of the tubing also generally requires that the reference chamber be positioned within a separate axial length from the operating piston. Accordingly, there is also a need for a system that provides the advantages of the prior system pertaining to the gas charge gas/liquid interface and that eliminates the need for the gas charge to be positioned within a separate axial length from the operating piston.

SUMMARY

To achieve such improvements, some embodiments of the present invention provides a subsurface safety valve that has a generally tubular body defining a bore therethrough. A closure member, such as a flapper, is attached to the body and is adapted to selectively open and close to control the flow of fluids through the bore. A flow tube is telescopically and moveably disposed within the bore to slide axially and selectively open and close the flapper. A spring mounted within the body biases the flow tube to the closed position in which the flapper is closed and prevents flow through the bore. Mounted within a cylinder defined in the wall of the body, a piston assembly attached to the flow tube facilitates control of the flow tube position from the surface.

One end of the piston assembly communicates with a fluid control passageway extending to the surface. The opposite end of the piston assembly communicates with a reference chamber housing a pressurized gas charge that biases the piston to the closed position (the position wherein the piston moves the flow tube such that the closure member, or flapper, is closed). First and second seals isolate the pressure within the piston assembly from the pressure within the bore. To provide for failsafe operation in the closed direction, the piston assembly incorporates an equalizing mechanism that equalizes the pressure above and below the piston in the event that the seals leak or fail allowing the spring to close the valve. In general, to accomplish the equalization, the piston assembly is formed of a first and second piston interconnected by a release mechanism. The piston assembly further includes a spring biasing the first and second piston to a first, or connected, position. Differential pressures within the piston assembly, caused by seal leakage or failure, may overcome the spring force and move the piston assembly to a released position in which the first and second pistons are disconnected from one another. When in the released position, the piston assembly moves the flow tube to the closed position providing for failsafe operation in the closed position.

Additionally, the present invention positions the reference chamber and the piston within the same axial length of the housing further reducing the length of the valve. To maintain the gas/liquid interface away from the piston, the present invention includes a specialized concentric conduit mechanism.

One aspect of the present invention provides a piston assembly for use in controlling a subsurface safety valve. The piston assembly includes a first piston having a piston bore therethrough and a second piston, a portion of which is removably mounted within the piston bore. A piston valve is attached to the first piston, the piston valve adapted to provide selective control of fluid flow through the piston bore. A release mechanism is adapted to releasably attach the first piston to the second piston. A spring biases the first piston and the second piston to a first position and selectively biases the piston valve to an open position.

Other features and embodiments will become apparent from the following description and from the claims.

Figure 1:
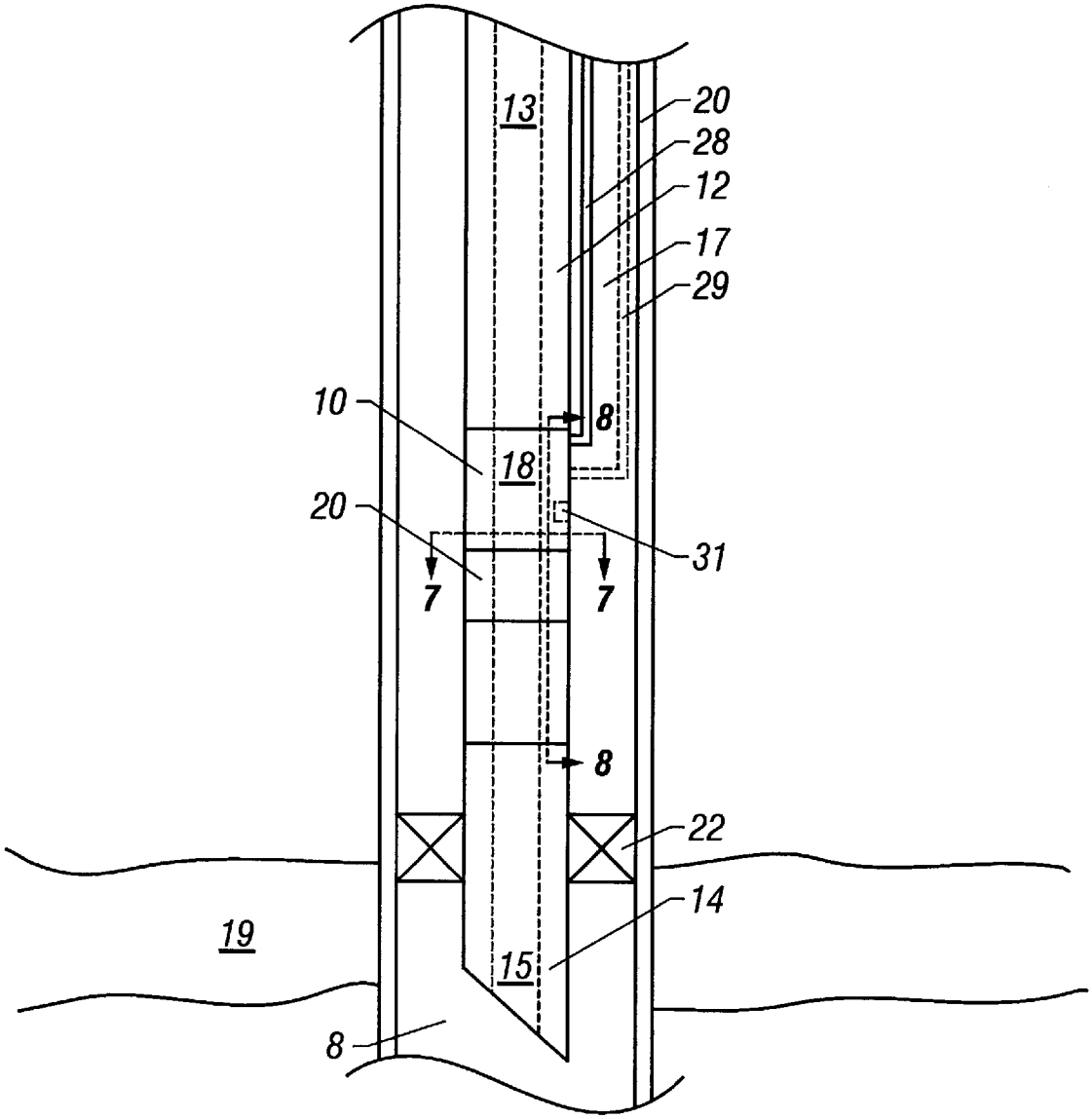
FIG. 1 illustrates an embodiment of a subsurface safety valve.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Generally, some embodiments of the present invention may include a subsurface safety valve that has a generally tubular body or housing defining a bore therethrough. A closure member, which may be a flapper, for example, is attached to the body and is adapted to selectively open and close to control the flow of fluids through the bore. A flow tube is telescopically and moveably disposed within the bore to slide axially and selectively open and close the flapper. A valve operating spring mounted within the body biases the flow tube to the closed position in which the flapper is closed to prevent flow through the bore. Mounted within a cylinder defined in the wall of the subsurface safety valve body, a piston assembly attached to the flow tube facilitates control of the flow tube position from the surface.

One end of the piston assembly communicates with a fluid control passageway extending to the surface. The opposite end of the piston assembly communicates with a reference chamber that may house a pressurized gas charge that biases the piston assembly to the closed position (the position wherein the piston assembly moves the flow tube such that the closure member is closed). First and second seals isolate the pressure within the piston assembly from the pressure within the bore. To provide for failsafe operation in the closed direction, the piston assembly incorporates an equalizing mechanism that equalizes the pressure above and below the piston assembly in the event that the seals leak or fail allowing the valve operating spring to close the valve. In general, to accomplish the equalization, the piston assembly is formed of a first and second piston interconnected by a release mechanism.

The piston assembly further includes a spring biasing the first and second pistons to a first, or connected, position. Differential pressures within the piston assembly, caused by seal leakage or failure, may overcome the biasing spring force and move the piston assembly to a released position in which the first and second pistons are disconnected from one another. When in the released position, pressure in the piston assembly is equalized allowing the valve operating spring to move the flow tube to the closed position providing for failsafe operation of the subsurface safety valve in the closed position.

Additionally, in some embodiments of the present invention, the reference chamber and the piston may be positioned within generally the same axial length of the valve housing to further reduce the length of the valve. To maintain a gas/liquid interface in the reference chamber away from the piston assembly, some embodiments of the present invention may include a specialized concentric conduit mechanism. The following discussion describes the safety valve and these individual components in greater detail.

As used herein, the terms "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may include a left to right or right to left relationship as appropriate.

Referring to FIG. 1, a subsurface safety valve 10 is connected to tubing sections 12 and 14 in a wellbore or well conduit 8. The wellbore 8 may be lined with casing 20, and a packer 22 may be set above the formation zone 19 to isolate an annulus 17 defined between the exterior of the tubing 12 and the inner wall of the casing 20. The tubing sections 12 and 14 and the subsurface safety valve 10 define respective longitudinal bores 13, 18, and 15 through which production fluids from a formation zone 19 may flow to the surface under normal operating conditions. The subsurface safety valve 10 may include some type of valve closure member 20 (e.g., a flapper valve, a ball valve, and so forth) that can be closed in response to predetermined abnormal conditions to block fluid flow to the well surface.

Figure 2:
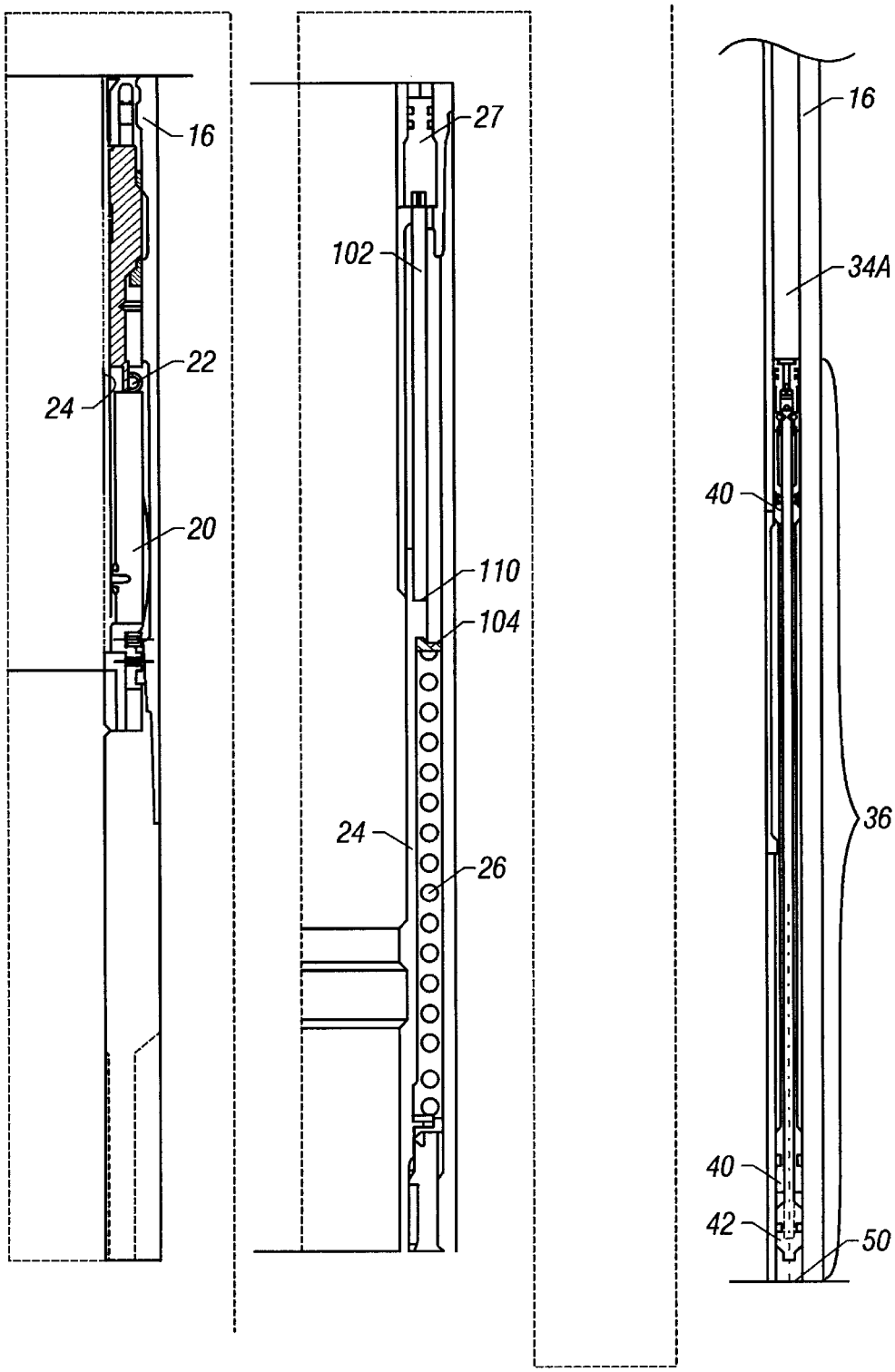
FIG. 2 illustrates a valve operator assembly according to one embodiment used in the subsurface safety valve of FIG. 1.

Referring to FIG. 2, a valve operator that includes a piston assembly 36, a valve operating spring 26, and a tubular member or flow tube 24 is illustrated. The valve closure member 20 (which in the illustrated embodiment is a flapper) is connected to the housing or body 16 of the valve by a pivot pin 22. When the flapper 20 is pivoted to an upper position, the safety valve 10 is closed, blocking flow upwardly through the valve bore 18 defined in the valve housing 16 and the bore of the well tubing 12.

The flow tube 24 is telescopically, moveably mounted in the valve housing 16. When the flow tube 24 is moved to a down position, the flow tube 24 pushes the flapper 20 down to hold the subsurface safety valve 10 in an open position. When the flow tube 24 is moved upwardly, the flapper 20 is allowed to rotate upwardly by action of the valve operating spring 26 to place the subsurface safety valve 10 in a closed position.

The subsurface safety valve 10 is controlled by the application or removal of a pressurized fluid, such as hydraulic fluid, through a fluid control passageway or control line 28 (shown in FIGS. 1 and 8A) which extends to the well surface or the casing-tubing annulus 16. Applied fluid pressure flows into a piston cylinder 34A defined in the valve housing 16 and offset from the valve bore 18. The flow path from the control line 28 to the cylinder 34A is described in more detail below in connection with FIGS. 6A–6B and 8A–8B. A pressure chamber 33 is defined in the cylinder 34A above the piston assembly 36 to receive a valve actuation pressure from the control line 28. Fluid pressure in the pressure chamber 33 is applied against the top of a piston assembly 36 positioned inside the cylinder 34A. The piston assembly 36 is movable up and down in the cylinder 34A by application and removal of fluid pressure to the chamber 33. If the applied pressure in the chamber 33 from the control line 28 is greater than a predetermined level, the piston assembly 36 acts on a push rod 102 that pushes the flow tube 24 down against the valve operating spring 26 to move the flow tube 24 downwardly to open the subsurface safety valve 10. The lower end of the push rod 102 is in abutment with an upper shoulder 110 extending from the flow tube 24.

The valve operating spring 26, in conjunction with a reference pressure applied in a reference chamber 50 (which may contain a gas charge, for example) urges the flow tube 24 upwardly to close the valve 10 if the pressure in the chamber 33 above the piston assembly 36 is reduced below the predetermined level. If the reference chamber 50 includes a gas charge, then the chamber 50 may also be referred to as a reference chamber. In the cylinder 34A, the reference chamber 50 is defined between the lower end of the piston assembly 36 and the upper end of a plug 27. The valve operating spring 26 acts against a lower shoulder 104 extending from the flow tube 24, and the reference chamber 50 is in communication with and acts against the lower end of the piston assembly 36.

In one embodiment, the reference chamber 50 is in communications with a gas charge stored in one or more cylinders located in the wall of the subsurface safety valve 10 (as described in greater detail in connection with FIGS. 6A–6B, 7, and 8A–8B). Alternatively, the reference chamber 50 may be in communications with a balance line 29 (FIG. 1) that extends from the surface that communicates fluid to the reference chamber 50 to provide a balance pressure. In yet a further embodiment, the reference chamber may be in communications with a port 31 in the housing of the valve 10 that is exposed to the annulus 17. The annulus pressure thus provides the reference pressure in the reference chamber 50.

Figure 3A:
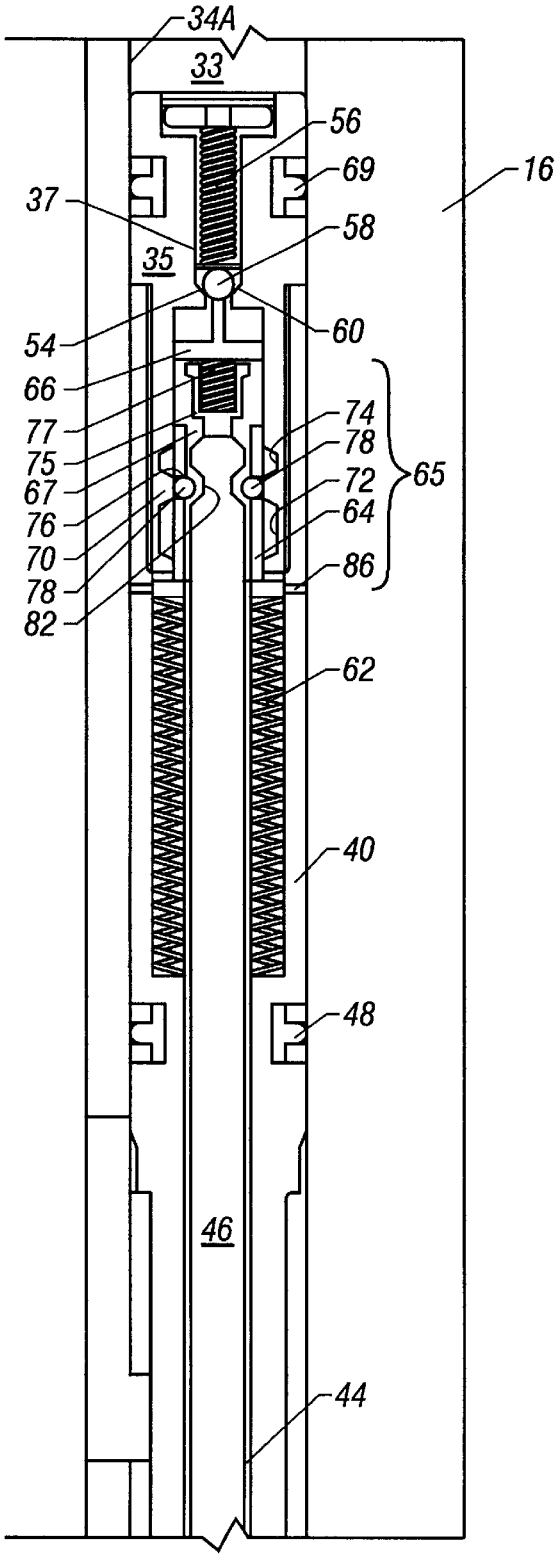
FIGS. 3A–3B, 4A–4B, and 5A–5B illustrate three different positions of a piston assembly in the valve operator assembly of FIG. 2.
Figure 3B:
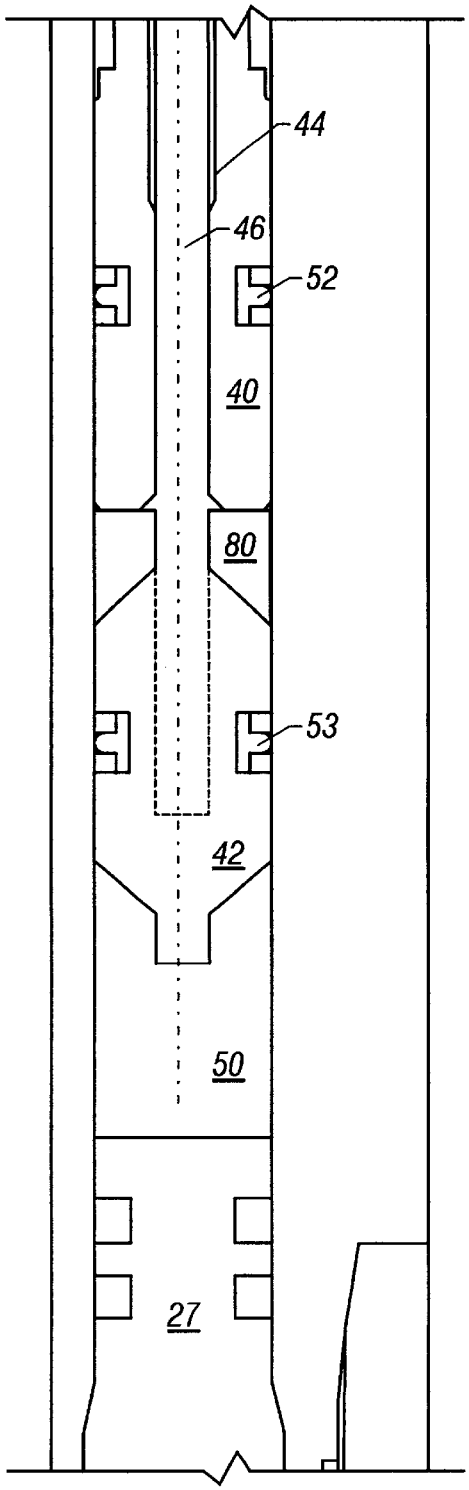

Referring further to FIGS. 3A–3B, the piston assembly 36 includes an upper piston 40, having an a top portion 35, and a lower piston 42 (the upper and lower pistons, 40 and 42, are also referred to herein as first and second pistons respectively). The upper piston 40 defines an equalization bore 44 (hereinafter referred to as the "piston bore") in which a piston rod 46 of the lower piston 42 is moveably mounted. The lower piston rod 46 is not sealed in the piston bore 44, and as a result, fluid may flow through the piston bore 44 around the lower piston rod 46. The outer wall of the upper piston 40 defines a recess in which a seal 69 sits, and the outer wall of the upper piston 40 defines two recesses in which seals 48 and 52 sit. The seal 69 is provided to isolate the piston bore 44 from the chamber 33. The seals 48 and 52 (also referred to herein as first and second seals respectively) are provided to isolate the piston bore 44 from the valve bore 18 of the subsurface safety valve 10. A recess is also defined in the outer wall of the lower piston 42 to receive a seal 53 that isolates the reference chamber 50 from a chamber 80 above the lower piston 42 that is in communication with the piston bore 44.

A piston valve 54 is mounted in the upper piston 40 of the piston assembly 36 to control fluid communication between the chamber 33 and the piston bore 44. The piston valve 54 includes a piston valve spring 56 that biases a sealing valve element 58 (which may be in the form of a ball, for example) against a seat 60 formed in the top portion 35.

A biasing spring 62 (which may be a Belleville spring, for example) is positioned in a groove defined in the inner wall of the upper piston 40. The biasing spring 62 pushes against the lower end of a piston connector 64 that is moveably mounted inside the piston bore 44. The piston connector 64 is in turn attached to a piston actuator 66. The biasing spring 62 has a spring strength that is greater than that of the piston valve spring 56. Consequently, if pressure less than a first level is applied against the top of the piston assembly 36, the piston valve actuator 66 pushes the valve element 58 away from the seat 60 due to the force applied by the biasing spring 62. As a result, the piston valve 54 is actuated to an open position to allow communication between the chamber 33 and the piston bore 44.

However, application of fluid pressure above the first level in the chamber 33 against piston assembly 36 pushes the valve element 58 against the seat 60 so that the piston valve 54 is actuated closed to isolate the piston bore 44 from the chamber 33. As further explained below, the piston valve 54, piston bore 44, and biasing spring 62 are part of an equalization mechanism to equalize the pressure in the chamber 33 and in the piston bore 44 in case of failure of seals 48 and 52 in the upper piston 40 to provide failsafe operation of the subsurface safety valve 10.

According to embodiments of the invention, the piston assembly 36 includes a releasable connection mechanism 65 connecting the upper piston 40 to the piston rod 46 of the lower piston 42. The releasable connection mechanism 65 is adapted to release the lower piston rod 46 from the upper piston 40 in the presence of a fluid leak into the piston assembly 36 due to failure of one or both of the seals 48 and 52. In one embodiment, the releasable connection mechanism 65 includes a detent 70 formed on the inner wall of the upper piston 40; a first indentation 74 above the detent 70 and a second indentation 72 below the detent 70, both formed in the inner wall of the upper piston 40; the piston connector 64; and retaining members 78 (e.g., locking balls).

The piston connector 64 defines a connector bore 67 into which the top portion of the lower piston rod 46 extends. The piston connector 64 also defines radial openings 76 that are in communication with the connector bore 67. In the illustrated position of FIG. 3A, the radial openings 76 are aligned longitudinally with the detent 70. The retaining members 78 may be fitted through the radial openings 76 formed in the piston connector 64. Portions of the retaining; members 78 may protrude into corresponding indentations or grooves 82 formed in the part of the lower piston rod 46 extending into the connector bore 67. As illustrated in FIG. 3A, releasable connection mechanism 65 is in the connected position, in which the retaining members 78 are at least partially positioned in the indentations 82 of the lower piston rod 46. In this position, the upper piston 40 is connected to the lower piston rod 46. However, in the presence of a leak in which fluid pressure from the valve bore 18 of the subsurface safety valve 10 leaks into the piston bore 44, the releasable connection mechanism 65 may be adapted to disconnect to allow the lower piston rod 46 to move downwardly in the piston bore 44 to thereby disconnect the lower piston 42 from the upper piston 40. When the releasable connection mechanism 65 is released, the retaining members 78 are removed from the indentations 82 in the lower piston rod 46.

Generally, in operation, the subsurface safety valve 10 opens as hydraulic pressure above a predetermined level (greater than pressure in the reference chamber 50) is applied into the control line 28 from the well surface or annulus 16 to the top of the piston assembly 36. The applied hydraulic pressure moves the piston assembly 36 downwardly in the cylinder 34A, which in turn moves the push rod 102 and flow tube 24 down to open the flapper 20. To close the subsurface safety valve 10, hydraulic pressure in the control line 28 is decreased below the predetermined level, which allows pressure in the reference chamber 50 to push the piston assembly 36 upwardly so that the flow tube 24 may be moved upwardly by the valve operating spring 26 to allow the flapper 20 to close.

Figure 4A:
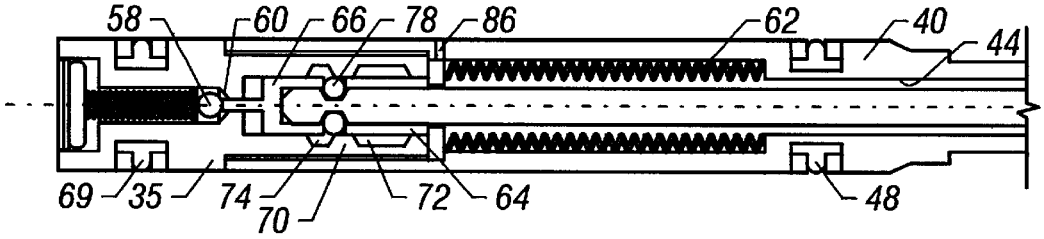
Figure 4B:
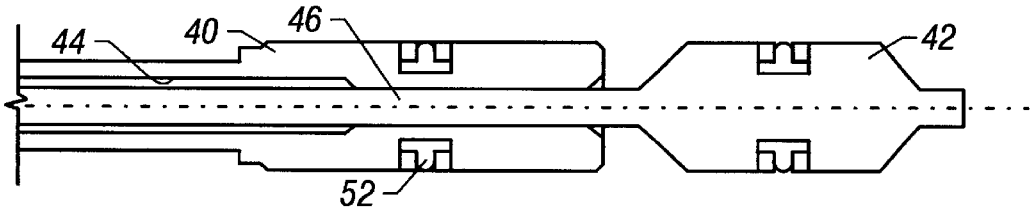
Figure 5A:
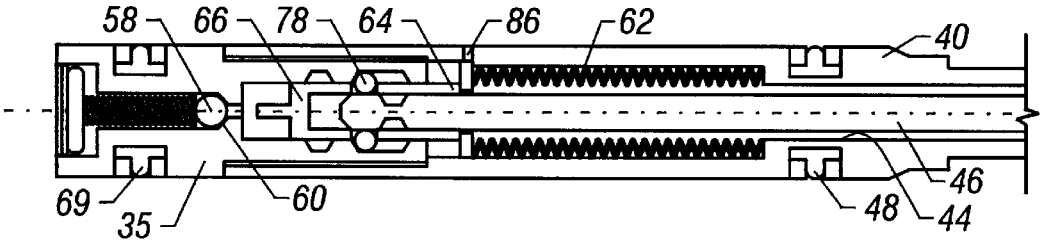
Figure 5B:
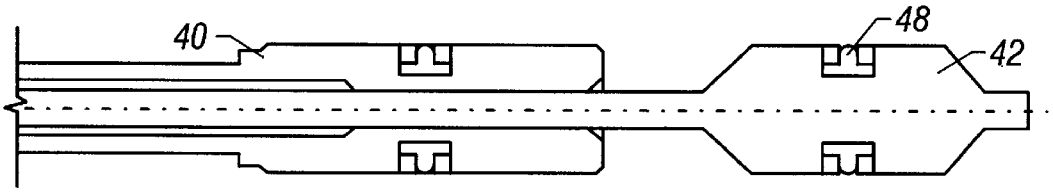

Referring to FIGS. 3A–3B, 4A–4B, and 5A–5B, the piston assembly 36 is shown in three different positions. Note that FIGS. 4A–4B and 5A–5B show an alternative embodiment that omits certain elements. Refer to FIG. 3A–3B during the discussion of these elements. FIGS. 4A–4B show the piston assembly 36 in a closed position (corresponding to the flapper 20 being closed) where pressure applied in the chamber 33 above the piston assembly 36 is less than the pressure in the reference chamber 50. FIGS. 3A–3B illustrate the piston assembly 36 in an open position (corresponding to the flapper 20 being open) where pressure applied against the piston assembly 36 in the chamber 33 is greater than the pressure in the reference chamber 50. FIGS. 5A–5B illustrate the piston assembly 36 in a disconnected position due to a fluid leak in either seal 48 or 52.

In the closed position shown in FIGS. 4A–4B, the biasing spring 62 pushes the piston valve actuator 66 upwardly to push the valve element 58 away from the seat 60 so that fluid communication occurs between the chamber 33 and the piston bore 44. Thus, in FIGS. 4A–4B, the biasing spring 62 is adapted to bias the piston valve 54 to an open position and to bias the releasable connection mechanism 65 to a connected position to thereby maintain the upper and lower pistons 40 and 42 connected. Effectively, the biasing spring 62 performs two tasks.

Initial application of hydraulic pressure in the chamber 33 flows into the piston bore 44. When the force applied against the top of the piston assembly 36 exceeds the upward force applied by the biasing spring 62 and any pressure in the reference chamber 50, the piston valve element 58 is pushed downwardly against the seat 60 to seal the piston bore 44 from the chamber 33 as shown in FIGS. 3A–3B. When this occurs, the pressure in the chamber 33 is applied across the piston assembly 36 with respect to the pressure in the reference chamber 50. When the force applied against the top of the piston assembly 36 exceeds that supplied by the reference chamber 50 and the valve operating spring 26, the piston assembly 36 is actuated to move downwardly to move the push rod 102 and flow tube 24 down to open the subsurface safety valve 10.

To close the subsurface safety valve 10, pressure is decreased in the chamber 33 to allow the reference chamber 50 pressure and valve operating spring 26 to push the flow tube 24 and piston assembly 36 upwardly to allow the flapper 20 to close.

Embodiments of the invention provide a failsafe mechanism in which the subsurface safety valve 10 is able to close even if certain seals in the piston assembly 36 fail. If failure of either seal 48 or 52 in the upper piston 40 occurs, then fluid pressure in the valve bore 18 is communicated to the piston bore 44. If the upper seal 48 leaks, then the valve bore 18 fluid flows through a radial opening 86 in the upper piston 40 into the piston bore 44. If the lower seal 52 fails, then the valve bore 18 fluid flows through the chamber 80 into the piston bore 44.

If the valve bore 18 pressure exceeds the pressure in the chamber 33 above the piston assembly 36 or the pressure in the reference chamber 50, the upper piston 40 and the lower piston 42 are pushed in opposite directions. This causes the lower piston rod 46 to move downwardly along with the retaining members 78 and piston connector 64. Downward movement of the retaining members 78 into the second indentation 72 that is below the detent 70 causes the retaining members 78 to fall out of the indentations 82 in the lower piston rod 46 and into the second indentation 72. When that occurs, the lower piston rod 46 is allowed to move past the retaining members 78, as illustrated in FIGS. 5A–5B. The second indentation 72 limits the travel of the retaining members 78 while the piston rod 46 is allowed to move down past them.

The connection mechanism 65 at this point is disconnected. When the lower piston rod 46 moves down, a locking ball retainer member 75 is pushed downwardly by spring 77 located inside the locking ball retainer member 75. The purpose of the locking ball retainer member 75 is to ensure that the locking balls 78 do not drop out of the radial openings 76 in the piston connector 64. In other embodiments, an alternative arrangement may be provided to keep the locking balls 78 from dropping out of the piston connector 64. For example, the lower piston rod 46 may be extended upwardly so that it does not move completely past the locking balls 78 in the disconnected position.

In the illustrated embodiment, once the lower piston rod 46 moves past the locking balls 78, the biasing spring 62 is able to push the piston connector 64 upwardly, which in turn moves the piston valve actuator 66 into contact with the piston valve element 58 to push it away from the seat 60.

This exposes the fluid pressure in the piston bore 44 to the chamber 33. As a result, the pressure above the piston assembly 36 is equalized with the pressure in the piston bore 44. Due to the equilibrium across the upper piston 40, the valve operating spring 26 is able to move the flow tube 24 upwardly to allow the flapper 20 to close. Note that the valve operating spring 26 need not be the conventional high powered spring previously used for closure of subsurface safety valves, but must only have sufficient power to overcome the forces of gravity and friction acting on the flow tube 24 and the piston assembly 36.

Once the pistons 40 and 42 are disconnected, it may desirable to reconnect the pistons. This may occur, for example, if leakage past the seals 48 and 52 are caused by a temporary condition in the well. If the seals 48 and 52 return to their normal working condition, then the valve bore 18 fluid pressure is isolated from the piston bore 44. This allows the reference chamber 50 to push the lower piston 42 and its push rod 46 upwardly. Upward movement of the lower piston rod 46 pushes the retaining members 78 past the detent 70 and into the upper indentation 74, which is adapted to facilitate reconnection of the releasable connection mechanism 65. Once the retaining members 78 are positioned in the upper indentation 74, further upward movement of the push rod 46 allows the retaining members 78 to fall into indentations 82 in the lower piston rod 46. As a result, the releasable connection mechanism 65 is returned to its connected position in which the lower piston rod 46 is connected to the upper piston 40.

If the seal 69 in the upper piston 40 fails, fluid in the chamber 33 is allowed to communicate past the seal 69 with the piston bore 44. In this condition, the pressure above the piston assembly 36 and the pressure in the piston bore 44 are in equilibrium so that the spring 26 can again force the flow tube 24 upwardly to close the flapper 20.

Thus, according to some embodiments, the upper and lower pistons 40 and 42 are releasably interconnected to one another using the releasable connection mechanism 65 in the piston assembly 36 of the subsurface safety valve 10. The upper and lower pistons 40 and 42 are biased to a connected position with the biasing spring 62. If some seals in the piston assembly 36 fail, fluid pressure on both sides of the upper piston 40 and the upper piston 40 are equalized to allow the reference pressure in the chamber 50 and the spring 26 to move the piston assembly 36 and the flow tube 24 upwardly to close the subsurface safety valve 10.

Figure 10:
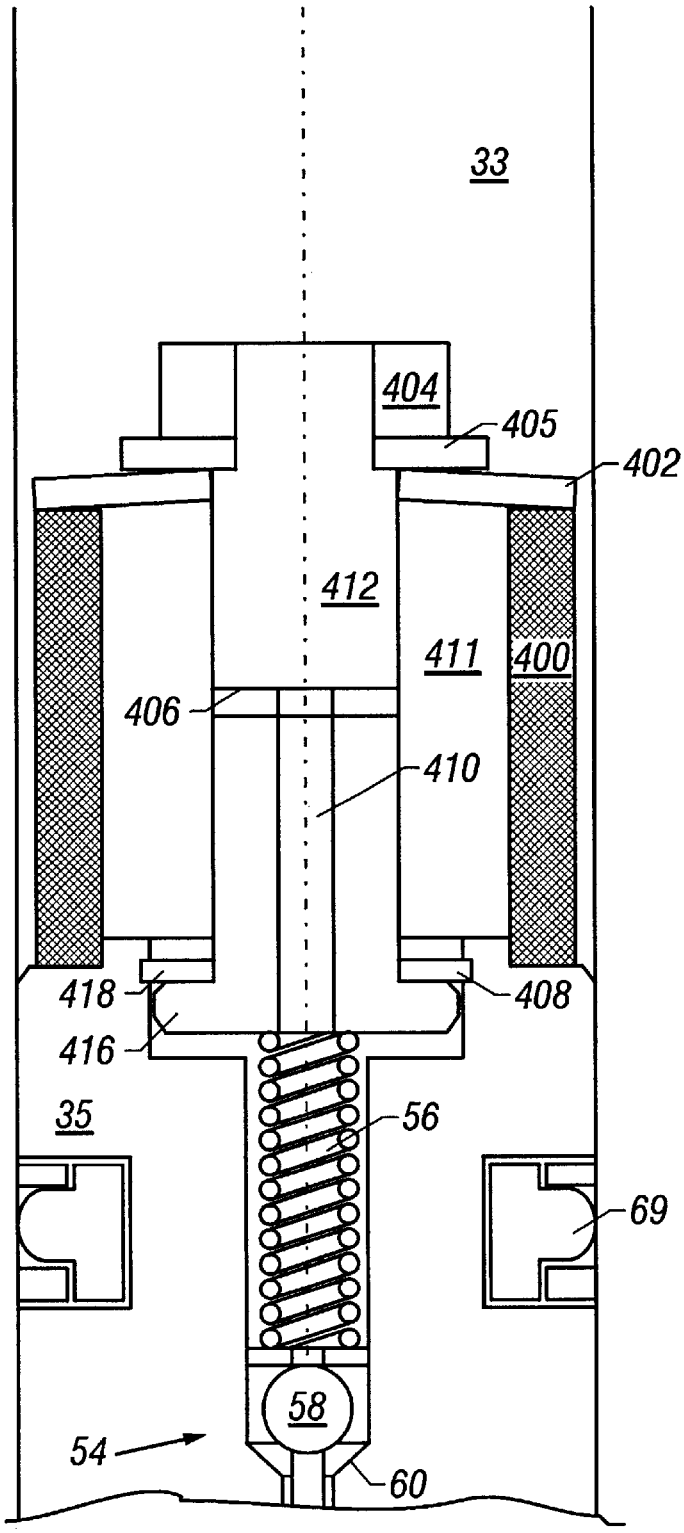
FIG. 10 illustrates an auxiliary filter in the alternative embodiment of a piston assembly.

Referring to FIG. 10, an alternative embodiment of the piston assembly is illustrated. In this embodiment, an auxiliary filter 400 is added to filter out any dirt or other debris that may be present in the chamber 33. By reducing the debris that may come into contact with the internal parts of the piston assembly 36, damage to the internal parts is less likely. In addition, by reducing buildup of debris on the valve element 58 and the seat 60, a better seal may be provided when the valve element 58 is engaged in the valve seat 60.

The auxiliary filter 400 is held in place proximal the piston valve 54 and the upper end of the piston bore 44 by a spring 402 (e.g., a Belleville spring). The Belleville spring 402 is fitted around a shaft 412. The spring 402 is held in place by a washer 405 and a nut 404 screwed onto the upper portion of the shaft 412. The shaft 412 includes a port 406 that provides a communications path from a space 411 inside the auxiliary filter 400 to an inner bore 410 of the shaft 412 that communicates fluid pressure to the valve element 58. Fluid in the cylinder 33 is filtered through the auxiliary filter 400, which in one embodiment may be formed of a sintered metal that is porous to liquid. A snap ring 408 is engaged into a slot 418 formed in the top portion 35 of the piston assembly 36. The snap ring 408 holds the shaft in place by engaging an upper surface of a flange portion 416 of the shaft 412. The lower surface of the shaft 412 is in engagement with the piston valve spring 56.

Figure 6A:
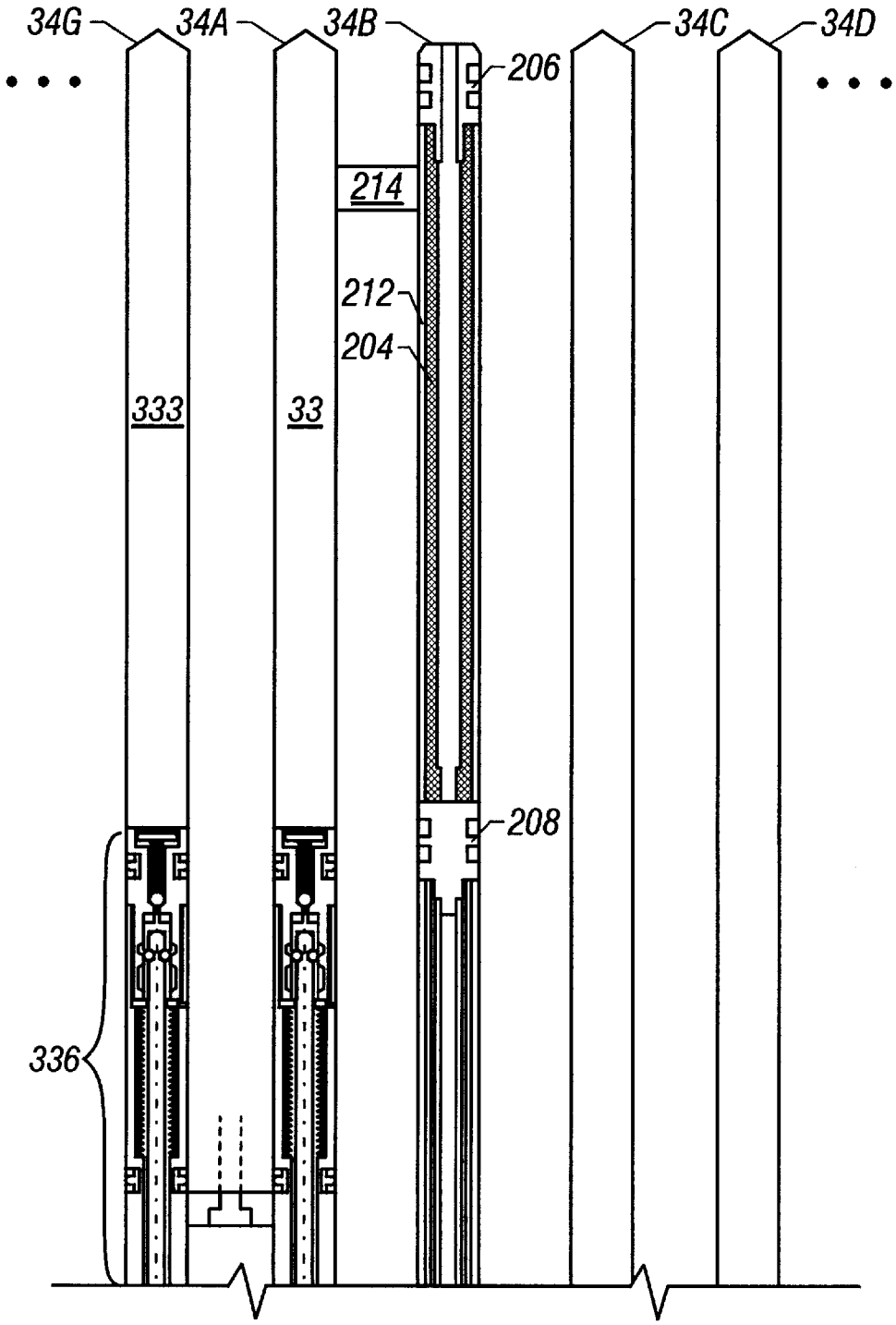
FIGS. 6A–6B illustrate a cylinder assembly according to one embodiment in the subsurface safety valve of FIG. 1.
Figure 6B:
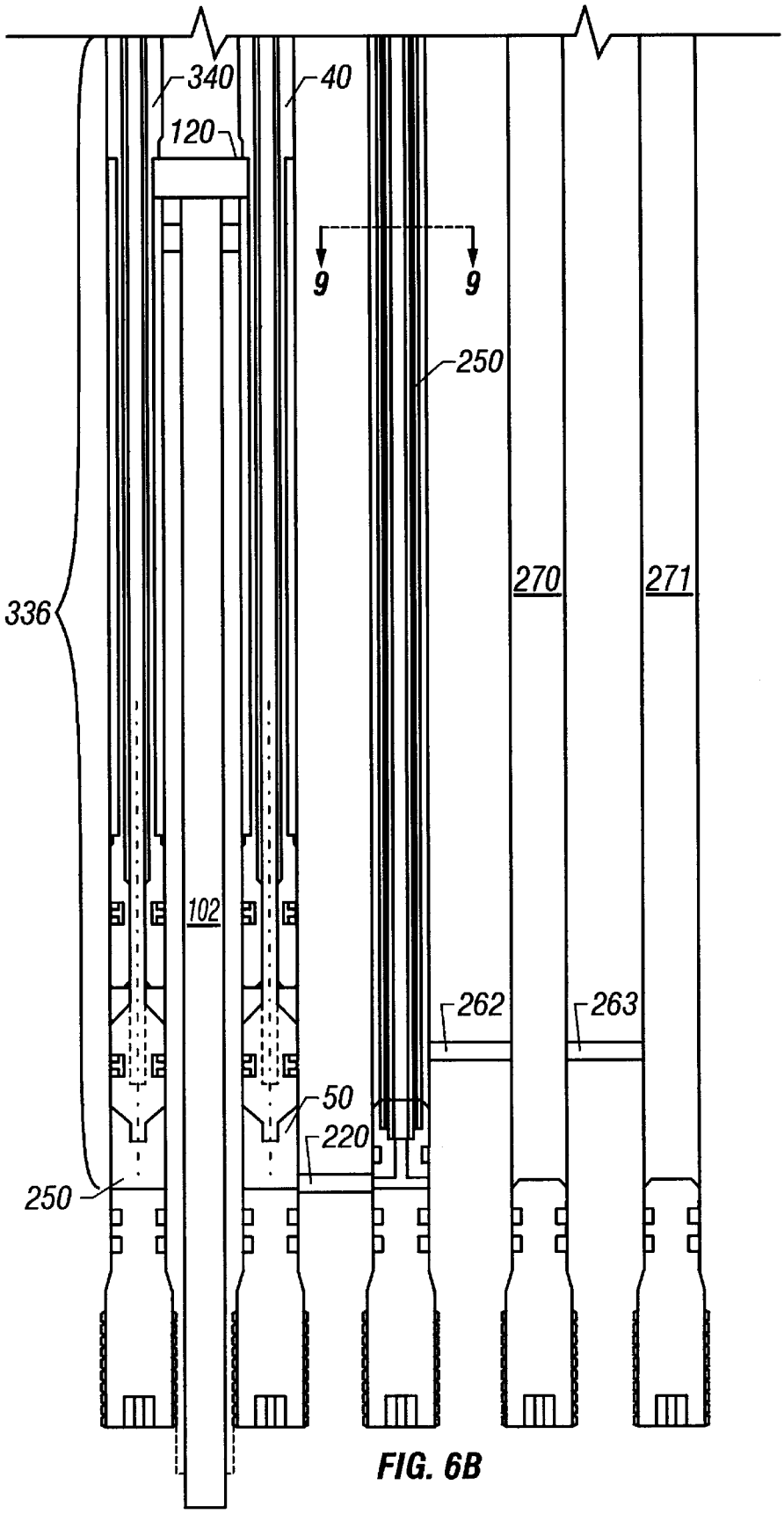
Figure 7:
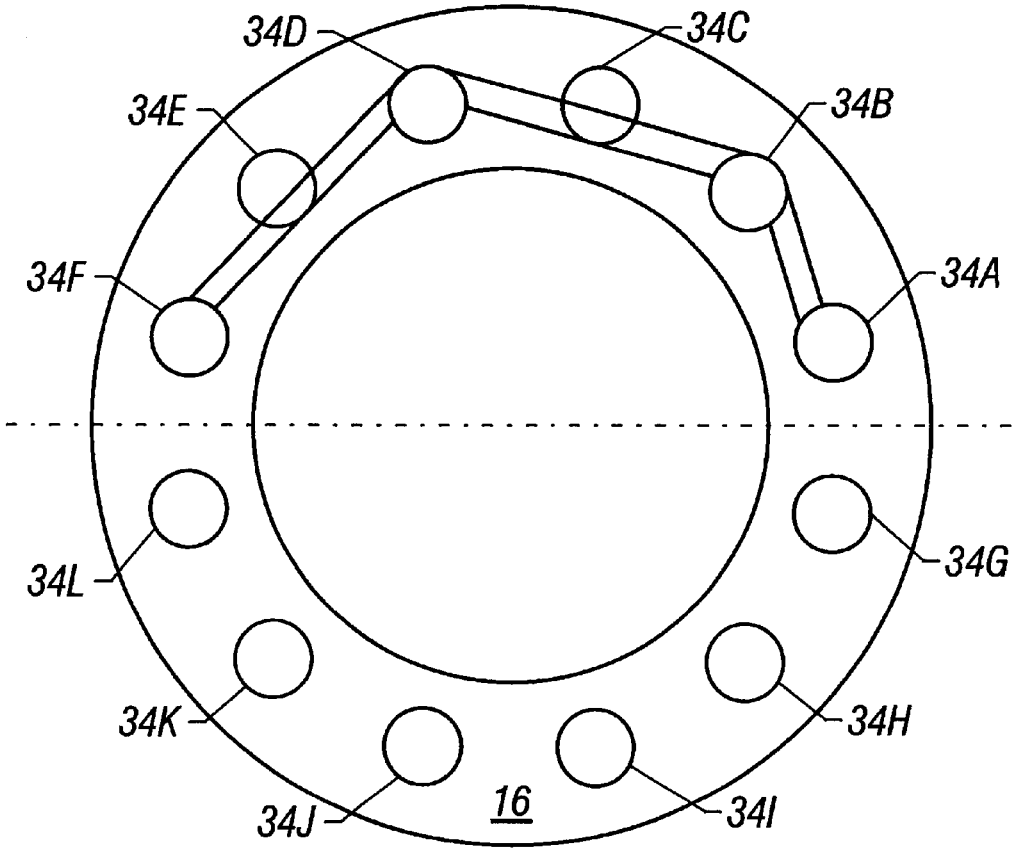
FIG. 7 is a cross-sectional view of the housing of the subsurface safety valve of FIG. 1 which defines a bore and cylinders offset from the bore.

Referring to FIGS. 6A–6B, several cylinders located in the wall of the valve housing 16 and offset from the valve bore 18 are illustrated. The cylinders along with the components in the cylinders are collectively referred to as a cylinder assembly. A cross-sectional view of the subsurface safety valve 10 in FIG. 7 illustrates twelve cylinders 34A–34L formed in the wall of the valve housing 16. The cylinders 34A–34L are offset from one another and are all located in generally the same axial length of the subsurface safety valve housing 16. Cylinders 34G, 34H, 34I, 34J, 34K, and 34L are redundant cylinders of cylinders 34A, 34B, 34C, 34D, 34E, and 34F, respectively. The cylinders 34A–34F are interconnected by fluid flow paths. The cylinders 34G–34L are similarly interconnected by fluid flow paths (not shown).

Figure 8A:
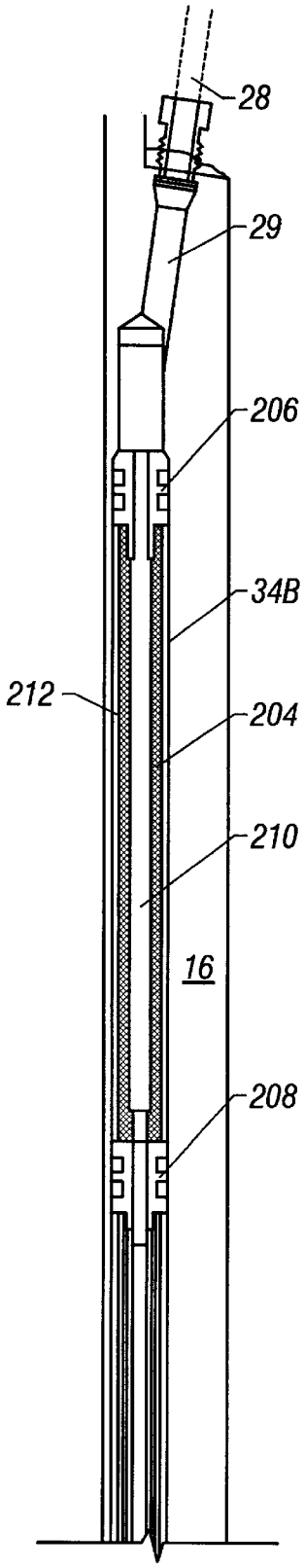
FIGS. 8A–8B illustrate a filter assembly in the subsurface safety valve of FIG. 1.
Figure 8B:
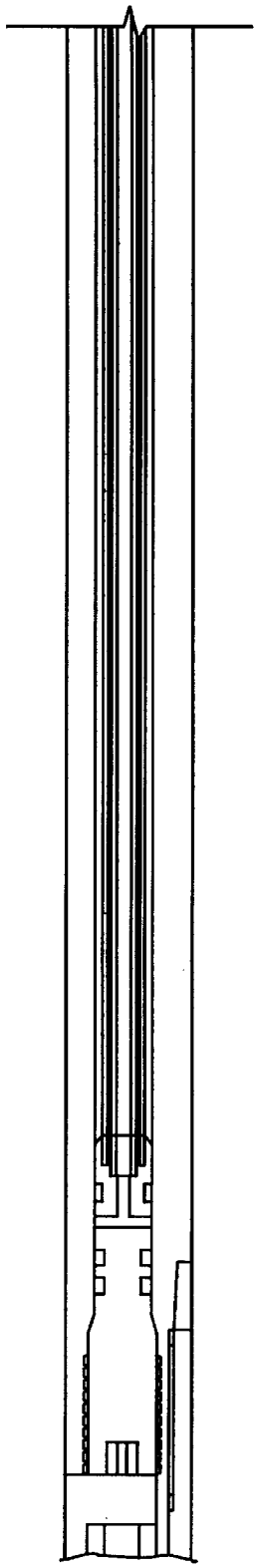

FIGS. 6A and 6B illustrate cylinders 34G and 34A–34D arranged planarly. Referring further to FIGS. 8A–8B, a longitudinal cross-sectional view taken of the subsurface safety valve 10 along cylinder 34B is illustrated. As illustrated in FIG. 8A, the control line 28 that extends either from the well surface or from the casing-tubing annulus 16 is coupled to a fluid port 29 that leads into the cylinder 34B. The fluid pressure applied in the control line 28 is communicated through the fluid port 29 into a filter element 204 positioned in the upper portion of the cylinder 34B. The filter element 204 is positioned between two sealing components 206 and 208. Fluid entering the inner bore 210 of the filter element 204 passes through the filter 204 into an annular region 212 between the outside of the filter 204 and the inner wall of the cylinder 34B. A fluid flow path 214 (FIG. 6A) allows fluid communication between the annular region 212 in the cylinder 34B and the upper portion of the piston cylinder 34A.

As further illustrated in FIGS. 6A and 6B, a redundant piston assembly 336 (arranged identically as the piston assembly 36) may be positioned in the redundant piston cylinder 34G adjacent the piston cylinder 34A. The redundant piston assembly 336 is provided in case of failure of the piston assembly 36 to control the position of the flow tube 24. The redundant piston assembly 336 has a first end that is in communication with a fluid control passageway to the well surface, which may be a separate passageway or the control line 28. The other end of the redundant piston assembly 336 is in communication with a reference chamber 250 that is identical to the reference chamber 50. Although not shown in FIGS. 6A–6B, a redundant cylinder 34H next to the cylinder 34G contains a redundant filter element similar to the filter element 204 positioned in the cylinder 34B. Redundant cylinders 34I–34L correspond to cylinders 34C–34F.

As illustrated in FIG. 6B, a top surface 120 of the push rod 102 is in abutment with a shoulder provided in the outer surface of each of upper pistons 40 and 340 in piston assemblies 36 and 336, respectively. Applied pressure above a predetermined level in pressure chambers 33 and 333 in cylinders 34A and 34G, respectively, pushes respective piston assemblies 36 and 336 downwardly to move the push rod 102, which is in abutment with the upper shoulder 110 of the flow tube 24 (FIG. 2).

In one embodiment, the pressure applied in the reference chamber 50 may be gas pressure supplied by a gas charge.

The reference chamber 50 is in communication with the cylinder assembly in which the remainder of the gas charge may be stored. To facilitate lubrication and sealing and to reduce the likelihood of damage to the seal 53 in the lower piston 42, the gas charge in the subsurface safety valve 10 may include a liquid, such as oil, between the gas and the lower surface of the lower piston 42. The gas/liquid interface is kept some distance away from the piston assembly 36. Typically, when the subsurface safety valve 10 is maintained substantially vertical, the gas/liquid interface is kept away from the lower surface of the lower piston 42. It is desirable, however, to maintain the gas/liquid interface away from the piston assembly 36 even when the subsurface safety valve 10 is placed in a horizontal or highly inclined position. This may occur, for example, during shipment or when the safety valve 10 is positioned in a horizontal or highly deviated well.

To ensure that the gas/liquid interface does not reach the lower surface of the piston assembly 36, a specialized concentric conduit mechanism, which includes a capillary device 250 according to one embodiment, may be used to separate the oil and gas. The capillary device 250, which includes a plurality of concentric tubes or conduits defining a plurality of flow paths, is positioned in the lower portion of the cylinder 34B underneath the filter 204.

Figure 9:
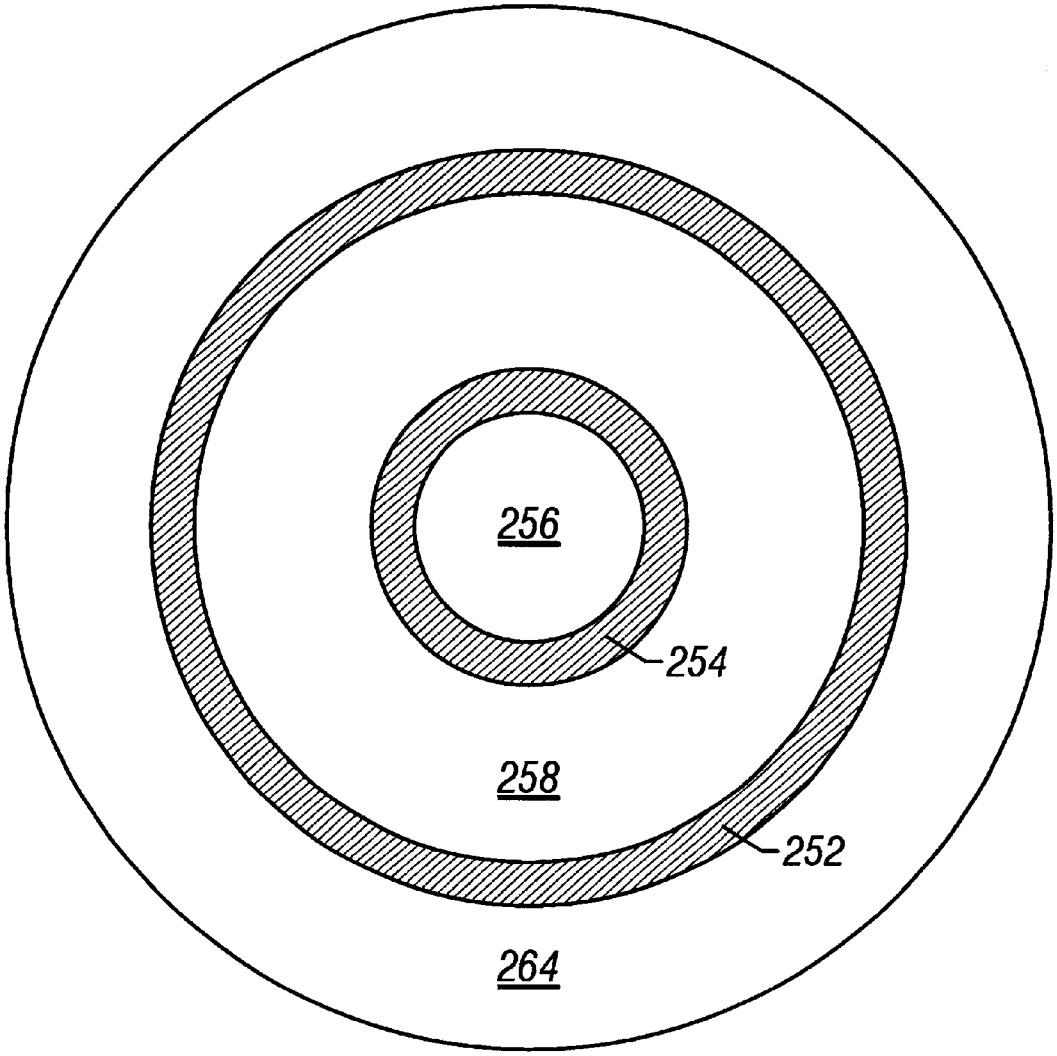
FIG. 9 is a cross-sectional view of a capillary device according to an embodiment in the subsurface safety valve of FIG. 1.

As further illustrated in FIG. 9, the capillary device 250 includes an outer conduit 252 that is disposed about the inner conduit 254. As illustrated, a first flow path 256 is defined by the inner conduit 254, and a second flow path 258 is defined by the annulus between the inner and outer conduits. The bottom end of the inner conduit 254 is in communication with an interior cavity which is the reference chamber 50.

Liquid stored in the reference chamber 50 communicates through a fluid path 220 into the first flow path 256 defined by the inner conduit 254. The first flow path 256 continues up to the top end of the inner conduit 254. Proximal the top end, the first flow path 256 is in communication with the annulus defining the second flow path 258. A plug 260 seals the annulus providing the second flow path 258 proximal the top end of the inner and outer conduits 254 and 252. Proximal the bottom end of the outer conduit 252, the second flow path 258 is in communication with an outer annulus 264 between the inner wall of the cylinder 34B and the outer wall of the outer conduit 252. The annulus 264 is in communication through a fluid path 262 with a first reference chamber 270 defined in a cylinder 34C next to cylinder 34B. In turn, the reference chamber 270 is in communication through a fluid path 263 with a reference chamber 271 in cylinder 34D, which is next to the cylinder 34C. Additional reference chambers may be defined in additional cylinders, such as cylinders 34E and 34F. In alternative embodiments, a lesser number or greater number of reference chambers may be used.

By storing the liquid inside the capillary device 250 and forming the first and second conduits 256 and 258 to have relatively small flow areas (e.g., 0.02 $in^2$), the capillary device 250 provides a capillary effect to prevent the liquid (e.g., oil) from being mixed with the gas in the reference chamber 270 so that the gas/liquid interface can be maintained away from the piston assembly 36 even if the subsurface safety valve 10 is in a horizontal, highly inclined, or upside down position. This allows the liquid to be maintained against the lower end of the piston assembly 36, thereby maintaining the lower end of the piston assembly lubricated and sealed.

As illustrated, the cylinders 34A–34L are generally positioned in the same axial region of the subsurface safety valve 10. Thus, an advantage offered by the capillary device 250 and reference chambers according to one embodiment to maintain the gas/liquid interface separated from the piston assembly 36 is that the separation assembly can be positioned in generally the same axial region of the safety valve system 10 as the piston assembly 36. As a result, the length of the subsurface safety valve 10 can be reduced over those of conventional subsurface safety valves, which decreases costs of manufacturing the subsurface safety valve as well as make more convenient shipping and handling of the subsurface safety valves 10.

While the invention has been disclosed with respect to a limited number of embodiments, other and further embodiments of the invention may be devised without departing from the basic scope thereof. For example, the particular configuration of the springs and shoulders may be changed, the balls of the release mechanism may have many configurations or be replaced by another release mechanism, such as a collet, and the relative positioning of the components within the valve may be changed. The scope thereof is determined by the claims which follow. It is the express intention of the applicant not to invoke 35 U.S.C. §112, paragraph 6 for any limitations of any of the claims herein, except when the claim expressly uses the word "means" with an associated function. It is intended that the appended claims cover all such further embodiments as fall within the true spirit and scope of the invention.

I claim:

1. A subsurface well safety valve for controlling the fluid flow through a well conduit, ocomprising:

a housing defining a bore and a cylinder offset from the bore;

a valve closure member selectively movable between an open position and a closed position adapted to control the fluid flow through the bore;

a flow tube telescopically, moveably mounted in the housing, the flow tube adapted to control the movement of the valve closure member;

a piston assembly positioned in the cylinder, the piston assembly connected to the flow tube;

the piston assembly having a first end communicating with a fluid control passageway to the well surface;

a reference chamber in the housing, the reference chamber communicating with a second end of the piston assembly and acting on the piston assembly in a direction to close the valve;

a first seal and a second seal of the piston assembly adapted to isolate the pressure in the cylinder above and below the respective first and second seals from the pressure in the bore; and the piston assembly further comprising:

a first piston having a piston bore therethrough;

a second piston at least a portion of which is moveably mounted within the piston bore;

a piston valve attached to the first piston, the piston valve adapted to provide selective control of fluid flow through the piston bore;

a release mechanism adapted to releasably attach the first piston to the second piston; and a spring biasing the first piston and the second piston to a first position and selectively biasing the piston valve to an open position.

2. The subsurface well safety valve of claim 1, further comprising:

a piston valve spring adapted to bias the piston valve to a closed position;

the first piston defining a detent in the piston bore;

a piston connector positioned within the piston bore, the piston connector defining a connector bore at least partially therethrough and at least one radial opening extending radially and communicating with the connector bore;

at least one retaining member moveably positioned in the at least one radial opening, a portion of the at least one retaining member extending from the at least one radial opening;

the second piston defining an indentation therein adapted and positioned to align with the at least one radial opening and adapted to receive at least a portion of the retaining member therein, the second piston selectively positionable within the connector bore;

the at least one retaining member adapted to selectively connect the piston connector to the second piston when the at least one retaining member is at least partially positioned in the indentation of the second piston;

the detent defining a connected position in which the retaining member is at least partially positioned in the indentation of the second piston and the detent defining a released position in which the retaining member is removed from the indentation of the second piston; and a spring positioned within the piston bore, the spring biasing the connector piston toward the piston valve, the spring also maintaining the piston connector in the piston bore.

3. The subsurface well safety valve of claim 2, further comprising:

the at least one retaining member comprising at least one ball.

4. The subsurface well safety valve of claim 2, further comprising:

the radial opening adapted to maintain the at least one retaining member at least partially therein.

5. The subsurface well safety valve of claim 2, further comprising:

the first piston further defining a first indentation below the detent; and the retaining member and the first indentation adapted to limit the travel of the piston connector when the piston is in the released position.

6. The subsurface well safety valve of claim 5, further comprising:

the first piston further defining a second indentation above the detent; and the first indentation adapted to facilitate reattachment of the retaining member to the second piston.

7. The subsurface well safety valve of claim 2, further comprising:

a piston valve actuator attached to the piston connector, the piston valve actuator adapted and positioned to selectively actuate the piston valve to an open position.

8. A piston assembly for use in controlling a subsurface safety valve, the piston assembly comprising:

a first piston having a piston bore therethrough;

a second piston, a portion of which is moveably mounted within the piston bore;

a piston valve attached to the first piston, the piston valve adapted to provide selective control of fluid flow through the piston bore;

a release mechanism adapted to releasably attach the first piston to the second piston; and a spring biasing the first piston and the second piston to a first position and selectively biasing the piston valve to an open position.

9. The piston assembly of claim 8, further comprising a filter positioned proximal one end of the piston bore to remove debris in fluid communicated to the piston bore.

10. The piston assembly of claim 8, wherein the piston valve is actuated at least in part by applied fluid pressure, the piston assembly further comprising a filter positioned proximal the piston valve to reduce debris reaching the piston valve.

11. A piston assembly for use in controlling a subsurface safety valve, the piston assembly comprising:

a first piston having a piston bore therethrough;

a second piston, a portion of which is moveably mounted within the piston bore;

a piston valve attached to the first piston, the piston valve adapted to provide selective control of fluid flow through the piston bore;

a piston valve spring adapted to bias the piston valve to a closed position;

the first piston defining a detent in the piston bore;

a piston connector positioned within the piston bore, the piston connector defining a connector bore at least partially therethrough and at least one radial opening extending radially and communicating with the connector bore;

at least one retaining member moveably positioned in the at least one radial opening, a portion of the at least one retaining member extending from the at least one radial opening;

the second piston defining an indentation therein adapted and positioned to align with the at least one connector bore and adapted to receive at least a portion of the retaining member therein, the second piston selectively positionable within the connector bore;

the at least one retaining member adapted to selectively connect the piston connector to the second piston when the at least one retaining member is at least partially positioned in the indentation of the second piston;

the detent defining a connected position in which the retaining member is at least partially positioned in the indentation of the second piston and the detent defining a released position in which the retaining member is removed from the indentation of the second piston;

a spring positioned within the piston bore, the spring biasing the connector piston toward the piston valve, the spring maintaining the piston connector in the piston bore, and the spring adapted to selective bias the piston valve to an open positions.

12. The subsurface well safety valve of claim 11, further comprising:

the at least one retaining member comprising at least one ball.

13. The subsurface well safety valve of claim 11, further comprising:

the radial opening adapted to maintain the at least one retaining member at least partially therein.

14. The subsurface well safety valve of claim 11, further comprising:

the first piston further defining a first indentation below the detent; and the retaining member and the first indentation adapted to limit the travel of the piston connector when the piston assembly is in the released position.

15. The subsurface well safety valve of claim 14, further comprising:

the first piston further defining a second indentation above the detent; and the first indentation adapted and positioned to facilitate reattachment of the retaining member to the second piston.

16. The subsurface well safety valve of claim 11, further comprising:

a piston valve actuator attached to the piston connector, the piston valve actuator adapted and position ed to selectively actuate the piston valve to an open position.

17. A method for providing a failsafe closure control for a subsurface safety valve that has a reference chamber to facilitate closing of the valve, a control line extending to the surface, and at least one seal isolating various pressure zones, the method comprising:

providing a first and a second piston releasably interconnected to one another and positioned in a cylinder assembly of the safety valve to form a piston assembly;

biasing the first and second piston to a connected position using a spring;

controlling the flow into the piston assembly using a piston valve selectively biased to an open position by the spring;

equalizing the fluid pressure on opposite sides of the piston assembly in the event of a failure of any one of the at least one seals; and allowing the safety valve to close in the event of a failure of any one of the at least one seals.

18. A subsurface safety valve, comprising:

a housing defining a bore and a housing wall;

the housing further defining a piston cylinder and at least one additional cylinder in the housing wall;

the piston cylinder and the at least one additional cylinder offset from one another;

at least a portion of the piston cylinder and the at least one additional cylinder positioned generally in the same axial length of the body;

a valve closure member selectively movable between an open position and a closed position, the valve adapted to control the fluid flow through the bore;

a flow tube telescopically, moveably mounted in the housing, the flow tube adapted to control the movement of the valve closure member;

a piston assembly in the piston cylinder;

the piston assembly connected to the flow tube;

the piston assembly having a first end communicating with a fluid control passageway to the well surface and adapted to control the position of the flow tube; and one of the at least one additional cylinders comprising a reference chamber, the reference chamber communicating with a second end of the piston assembly and acting on the piston assembly in a direction to close the valve.

19. The subsurface safety valve of claim 18, further comprising:

the piston cylinder and the at least one additional cylinder positioned generally in the same axial length of the body.

20. The subsurface safety valve of claim 18, further comprising:

a filter positioned in the same one of the at least one additional cylinders as the reference chamber.

21. The subsurface safety valve of claim 18, further comprising:

the housing further defining at least one redundant piston cylinder and at least one redundant additional cylinder in the housing wall;

the redundant piston cylinder and the at least one redundant additional second cylinder offset from one another;

at least a portion of the redundant piston cylinder and the at least one redundant additional cylinder positioned generally in the same axial length of the body;

a redundant piston assembly in the at least one redundant piston cylinder;

the redundant piston assembly connected to the flow tube;

the redundant piston assembly having a first end communicating with a fluid control passageway to the well surface and adapted to control the position of the flow tube; and one of the at least one redundant additional cylinders comprising a reference chamber, the reference chamber communicating with a second end of the redundant piston assembly and acting on the redundant piston assembly in a direction to close the valve.

22. A reference chamber assembly for use with a subsurface safety valve that has a gas charge to facilitate closure of the safety valve, the safety valve having a body defining a bore and a reference chamber cylinder therein, the safety valve further having a piston assembly adapted to facilitate closure of the safety valve, the assembly comprising:

a first conduit having a first end and a second end, the first end defining an interior cavity communicating with an end of the piston assembly;

a second conduit, having a first end and a second end, the second conduit disposed about the first conduit;

the first and second conduits defining an annulus therebetween;

the interior cavity of the first conduit in fluid communication with the inner annulus proximal the second ends of the first and second conduits;

the inner annulus sealed proximal the second ends of the first and second conduits;

the second conduit and the reference chamber cylinder defining an outer annulus therebetween; and the inner annulus and the outer annulus in fluid communication proximal the first end of the second conduit.

23. The reference chamber assembly as claimed in claim 22, further comprising: the cross sectional area of the interior cavity and inner annulus are relatively small.

24. A valve assembly for use in a wellbore, comprising:

a valve element;

a pressure chamber adapted to receive a valve actuation pressure; and a valve operator adapted to actuate the valve element between an open and closed position, the valve operator including a piston assembly comprising:

a first piston having an equalization bore, a second piston having a portion positioned in the equalization bore and releasably connected to the first piston, a piston valve adapted to control communication between the equalization bore and the pressure chamber, and a biasing spring adapted to bias the first and second pistons in a connected position and to bias the piston valve to an open position.

25. The valve assembly of claim 24, wherein the piston valve is actuated to a closed position when a pressure greater than a predetermined level is present in the pressure chamber.

26. The valve assembly of claim 24, wherein the valve operator further includes a reference chamber containing a reference pressure in communication with a first end of the piston assembly, the pressure chamber being in communication with a second, opposite end of the piston assembly.

27. The valve assembly of claim 26, further comprising an element containing a gas charge that is in communication with the reference chamber.

28. The valve assembly of claim 26, further comprising a fluid line communicating a fluid pressure to the reference chamber.

29. The valve assembly of claim 26, further comprising a port providing a fluid communications path between the reference chamber and an annulus region in the wellbore.

30. The valve assembly of claim 24, further comprising:

a valve bore and a cylinder offset from the valve bore, the pressure chamber and valve operator positioned in the cylinder; and a seal to isolate fluid communication between the valve bore and the piston assembly, wherein the first and second pistons are adapted to be released in the presence of fluid from the valve bore leaking past the seal of greater than a predetermined pressure.

31. The valve assembly of claim 24, wherein the piston assembly further comprises a releasable connection mechanism biased by the biasing spring to a first, connected position to connect the first and second pistons.

32. The valve assembly of claim 31, further comprising a fluid path and a seal to isolate fluid communication between the fluid path and the piston assembly, the releasable connection mechanism adapted to be released in the presence of fluid from the fluid path leaking past the seal of greater than a predetermined pressures.

* * * * *